US005741376A

United States Patent [19]

Subramanian et al.

[11] Patent Number: 5,741,376

[45] Date of Patent: Apr. 21, 1998

[54] HIGH TEMPERATURE MELTING NIOBIUM-TITANIUM-CHROMIUM-ALUMINUM-SILICON ALLOYS

[75] Inventors: P. R. Subramanian, Dayton; Madan G. Mendiratta; Dennis M. Dimiduk, both of Beavercreek, all of Ohio

[73] Assignee: The United States of America as represented by the Secretary of the Air Force, Washington, D.C.

[21] Appl. No.: 647,215

[22] Filed: May 9, 1996

[51] Int. Cl.[6] ..... C22C 27/02

[52] U.S. Cl. ..... 148/422; 420/426

[58] Field of Search ..... 148/407, 422; 420/426

[56] References Cited

U.S. PATENT DOCUMENTS

| | | | |
|---|---|---|---|
| 2,822,268 | 2/1958 | Hix | 420/426 |
| 3,753,699 | 8/1973 | Anderson et al. | 420/426 |
| 4,983,358 | 1/1991 | Hebsur et al. | 148/407 |
| 4,990,308 | 2/1991 | Jackson | 420/426 |
| 5,366,565 | 11/1994 | Jackson | 148/422 |

FOREIGN PATENT DOCUMENTS

| | | | |
|---|---|---|---|
| 803937 | 11/1958 | United Kingdom | 420/426 |

OTHER PUBLICATIONS

Subramanian et al., "The Development of Nb–based Advanced Intermetallic Alloys for Structural Applications," J. Metals, 48(1), pp. 33–36 (Jan. 1996).

*Primary Examiner*—John Sheehan

*Attorney, Agent, or Firm*—Bobby D. Scearce; Thomas L. Kundert

[57] ABSTRACT

High temperature melting niobium-titanium-chromium-aluminum-silicon alloys having a wide range of desirable microstructures, excellent microstructural and morphological properties, superior oxidation resistance at temperatures from 1000° C. to 1500° C., and good low temperature toughness and good high temperature strength and creep resistance are described which comprise generally two- or three-or four-phase alloys systems having compositions (31-41)Nb-(26-34)Ti-(8-10)Cr-(6-12)Al-(9-18)Si. Two-phase beta+$Nb_5Si_3$-base alloys can be obtained by increasing the Nb/Ti ratio, while three-phase beta+$Nb_5Si_3$-base+$Ti_5Si_3$-base alloys or four-phase beta+$Nb_5Si_3$-base+$Ti_5Si_3$-base +$Ti_3Si$-base alloys can be obtained by decreasing the Nb/Ti ratio.

13 Claims, 8 Drawing Sheets

HIGH TEMPERATURE MELTING NIOBIUM-TITANIUM-CHROMIUM-ALUMINUM-SILICON ALLOYS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to high temperature resistant alloys, and more particularly to high temperature melting niobium-titanium-chromium-aluminum-silicon alloy systems having a wide range of desirable microstructures, excellent microstructural and morphological stability, and superior oxidation resistance at temperatures to about 1500° C.

Advanced propulsion systems require new materials which can withstand high temperatures for extended periods of time. Conventional (primarily nickel or cobalt based) superalloys presently used in high temperature engine applications may be inadequate to meet temperature requirements of advanced aerospace systems. State-of-the-art niobium based refractory alloy systems exhibit high temperature oxidation tolerance but suffer from poor creep resistance at elevated temperatures. Selected ordered intermetallic compounds based on refractory silicides under consideration for high temperature application have high melting temperatures and high stiffness, low densities, and good strength retention at elevated temperatures, but, in monolithic form, have inadequate damage tolerance and extremely low fracture toughness at low temperatures.

The invention solves or substantially reduces in critical importance problems associated with conventional high temperature alloys for engine applications by providing high temperature melting niobium-titanium-chromium-aluminum-silicon alloys and method for making them, the alloys of the invention comprising a material system which possesses a two-phase, three-phase or four-phase microstructure comprising a ductile phase for low temperature damage tolerance and one or more high temperature melting intermetallic phases for high temperature strength and creep resistance, where the phases in equilibrium are beta Nb-Ti base solid solution, $Nb_5Si_3$-base, and $Ti_5Si_3$-base silicides. The alloys of the invention exhibit excellent microstructural and morphological stability to about 1500° C., low metal recession rates combined with an adherent, continuous scale formation upon exposure to air at 1200° C. and 1300° C., and good strength retention to about 1100° C.

It is therefore a principal object of the invention to provide improved high temperature melting niobium-titanium-chromium-aluminum-silicon alloys and method for producing the alloys.

It is a further object of the invention to provide improved niobium-titanium-chromium-aluminum-silicon alloys having a wide range of desirable microstructures.

It is another object of the invention to provide improved niobium-titanium-chromium-aluminum-silicon alloys having excellent microstructural and morphological properties.

It is another object of the invention to provide niobium-titanium-chromium-aluminum-silicon alloys having superior oxidation resistance at temperatures from 1000° C. to 1500° C.

It is yet another object of the invention to provide niobium-titanium-chromium-aluminum-silicon alloys having good low temperature toughness and good high temperature strength and creep resistance.

It is yet another object of the invention to provide improved high temperature melting niodobium-titanium-chromium-aluminum-silicon alloys for advanced aerospace propulsion systems.

These and other objects of the invention will become apparent as a detailed description of representative embodiments proceeds.

SUMMARY OF THE INVENTION

In accordance with the foregoing principles and objects of the invention, high temperature melting niobium-titanium-chromium-aluminum-silicon alloys having a wide range of desirable microstructures, excellent microstructural and morphological properties, superior oxidation resistance at temperatures from 1000° C. to 1500° C., and good low temperature toughness and good high temperature strength and creep resistance are described which comprise generally two- or three-or four-phase alloys systems having compositions (31-41)Nb-(26-34)Ti-(8-10)Cr-(6-12)Al-(9-18)Si. Two-phase beta+$Nb_5Si_3$-base alloys can be obtained by increasing the Nb/Ti ratio, while three-phase beta+$Nb_5Si_3$-base+$Ti_5Si_3$-base alloys or four-phase beta+$Nb_5Si_3$-base+$Ti_5Si_3$-base+$Tri_3Si$-base alloys can be obtained by decreasing the Nb/Ti ratio.

BRIEF DESCRIPTION OF THE DRAWINGS

The invention will be more clearly understood from the following detailed description of representative embodiments thereof read in conjunction with the accompanying drawings wherein.

DETAILED DESCRIPTION

Figure 1A:
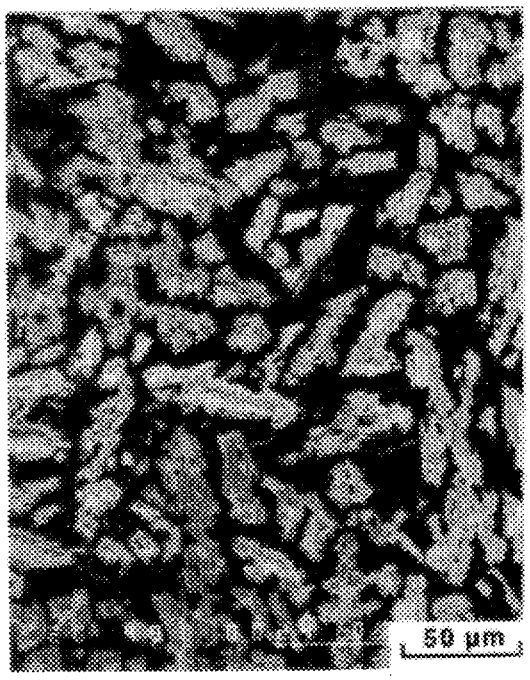
FIGS. 1*a*, 1*b*, 1*c*, 1*d* show backscattered scanning electron microscopy (SEM) micrographs for four different representative alloys (#1, 2, 4 and 6) of the invention in the as-cast condition.
Figure 1B:
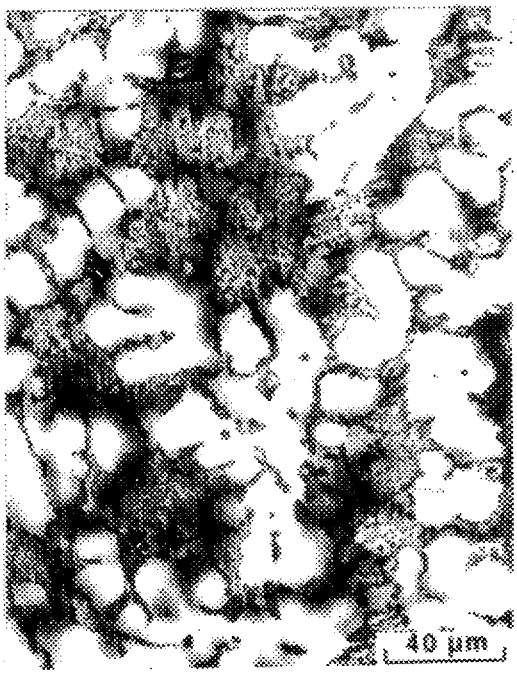
Figure 1C:
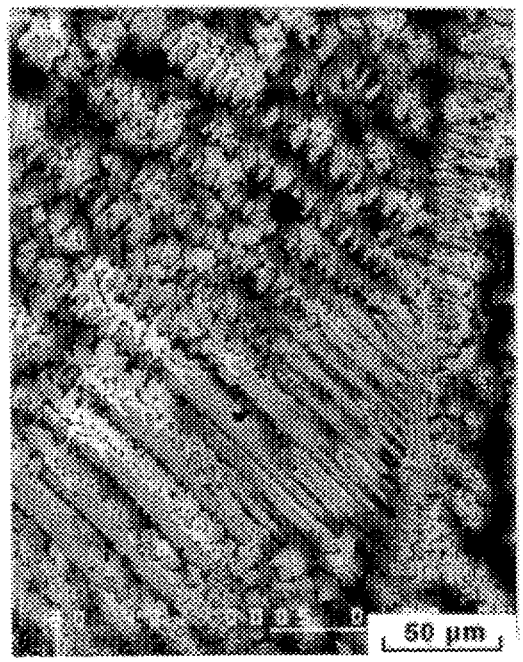
Figure 1D:
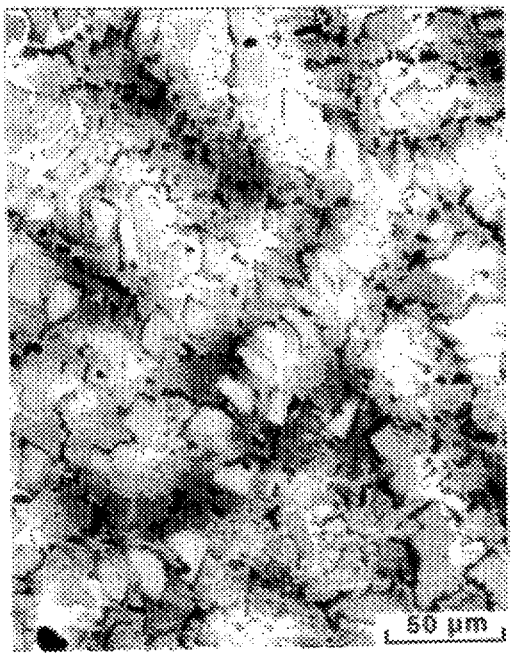
Figure 2A:
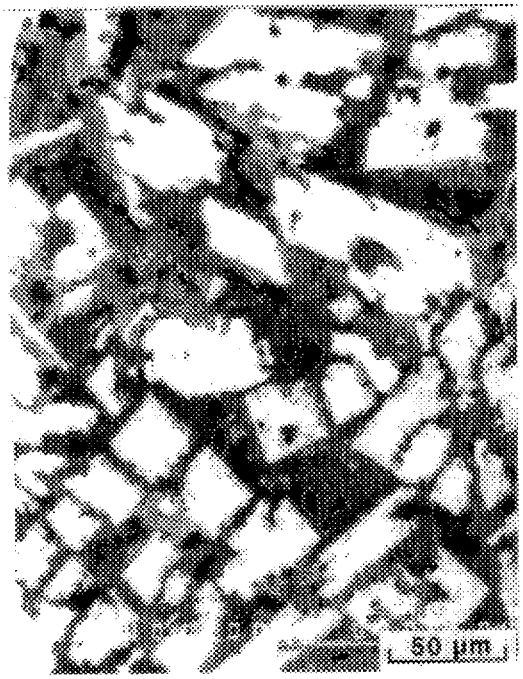
FIGS. 2*a* and 2*b* show backscattered SEM micrographs, respectively, for the alloys of FIGS. 1*a* and 1*b* after heat treatment at 1200° C. for 100 hours.
Figure 2B:
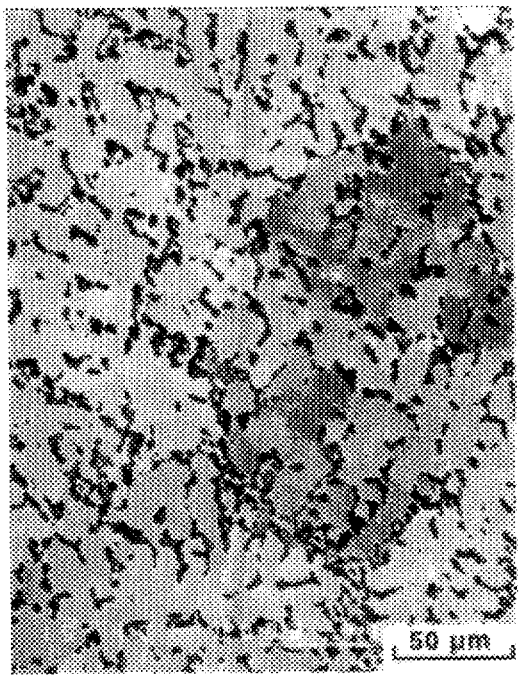
Figure 2C:
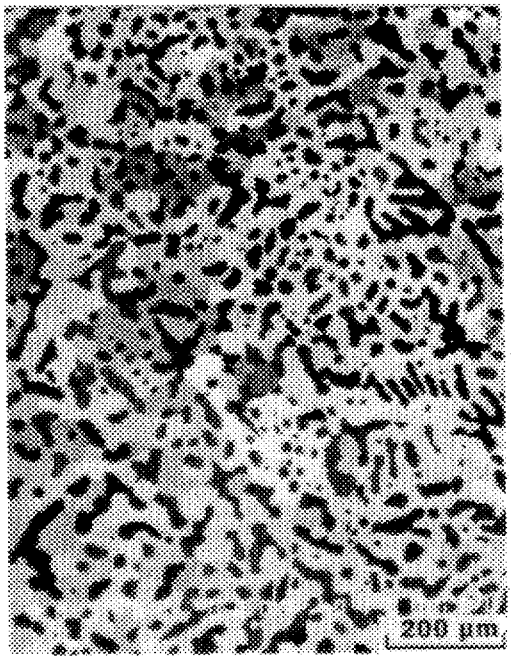
FIGS. 2*c* and 2*d* show backscattered SEM micrographs, respectively, for the alloys of FIGS. 1*c* and 1*d* after heat treatment at 1500° C. for 100 hours.
Figure 2D:
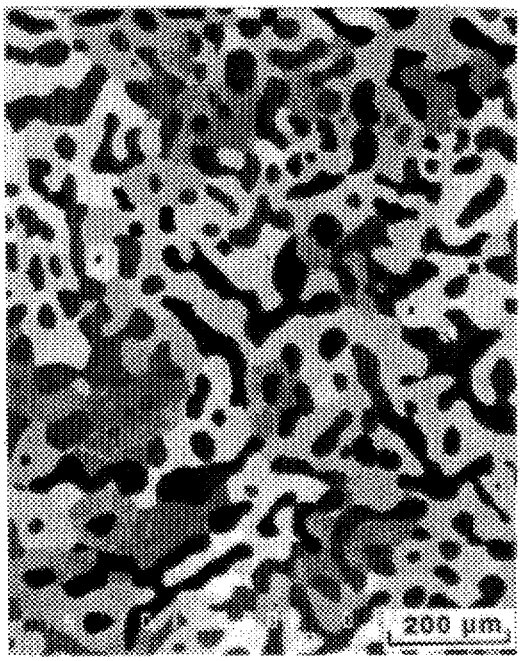

A discussion of refractory material systems related to the present invention is presented in Subramanian et al, "The Development of Nb-Based Advanced Intermetallic Alloys for Structural Applications," *J Metals*, 48(1), 33–36 (1996), the entire teachings of which are incorporated by reference herein.

In preparation of alloys according to the invention, the ductile refractory base alloy system 40Nb-40Ti-10Cr-10Al (percentages throughout are in atomic percent (at %) unless otherwise indicated) was selected. Silicon was then added at 18 at % at the expense of Nb and Ti in equal proportions. The resultant composition of the composite system was 31Nb-31Ti-10Cr-10Al-18Si. In subsequent iterations, the alloy compositions were modified by increasing the Nb/Ti ratio for increasing the temperature capability of the alloy system composition. Further, the Si concentrations were varied to obtain the optimum micro structure in terms of the volume fraction of the beta phase in equilibrium with the intermetallic phases. The Al concentrations were also varied for each iteration. The resulting alloy compositions were in the ranges (31-41)Nb-(26-34)Ti-(8-10)Cr-(6-12)Al-(9-18)Si. The compositions of various alloys prepared in demonstration of the invention are listed in Table I.

TABLE I

| Alloy | Alloy Composition (at %) | | | | |
|---|---|---|---|---|---|
| # | Nb | Ti | Cr | Al | Si |
| 1 | 31 | 31 | 10 | 10 | 18 |
| 2 | 41 | 33 | 10 | 7 | 9 |
| 3 | 38 | 29 | 8 | 12 | 13 |
| 4 | 39 | 30 | 9 | 11 | 11 |
| 5 | 36 | 34 | 9 | 6 | 15 |
| 6 | 38 | 31 | 8 | 10 | 13 |
| 7 | 41 | 27 | 8 | 10 | 15 |
| 8 | 40 | 26 | 8 | 9 | 17 |

Alloys #1 through #6 were prepared in the form of 250-gram cigars by arc-melting the constituent elements under an atmosphere of purified argon in a water-cooled copper hearth, using a non-consumable tungsten electrode. Alloys #7 and #8 were obtained in the form of cast billets (~2.5 inch diam×6 inch long). Samples sectioned from the arc-melted buttons or billets were annealed at 1500° C. for 100 hours or 1200° C. for 100 hours. In order to minimize contamination with oxygen and nitrogen during exposure to high temperatures, all of the annealing treatments were conducted with the samples wrapped in Ta foil and were performed under an atmosphere of flowing argon, which was first gettered over Ti chips heated to 800° C. Samples sectioned from the annealed alloys as well as the arc-melted buttons were prepared for metallography using standard techniques. Backscattered SEM and quantitative electron probe microanalysis were conducted to characterize the microstructure and composition of the equilibrium phases.

FIGS. 1*a–d* show the backscattered SEM micrographs of four representative alloys (#1, #2, #4, #6) in the as-cast condition. FIGS. 2*a–d* show the backscattered SEM micrographs of alloys #1 and #2 after heat-treatment at 1200° C. for 100 hours, and alloys #4 and #6 after heat-treatment at 1500° C. for 100 hours. All of the alloys showed a two-phase or three-phase microstructure at the test temperatures. The compositions of the phases are listed in Table II.

TABLE II

| Alloy | Condition | Phase A (at %) | Phase B (at %) | Phase C (at %) |
|---|---|---|---|---|
| #1* | 1200° C./100 h | 29.8 Nb-42.0 Ti-10.0 Cr -17.7 Al-0.5 Si | 36.4 Nb-25.3 Ti-1.9 Cr -4.3 Al-32.1 Si | 21.6 Nb-39.4 Ti-2.1 Cr -6.4 Al-30.5 Si |
| #2 | 1200° C./100 h | 43.8 Nb-35.2 Ti-12.5 Cr -7.8 Al-0.7 Si | 37.7 Nb-25.2 Ti-0.5 Cr -1.7 Al-34.9 Si | 26.9 Nb-34.8 Ti-1.2 Cr -3.4 Al-33.7 Si |
| #3 | 1200° C./100 h | 39.3 Nb-34.7 Ti-11.0 Cr -14.4 Al-0.6 Si | 41.2 Nb-21.0 Ti-1.3 Cr -7.0 Al-29.5 Si | 27.7 Nb-34.2 Ti-1.6 Cr -6.6 Al-29.9 Si |
| #4 | 1500° C./100 h | 41.6 Nb-33.0 Ti-11.9 Cr -12.5 Al-1.0 Si | 36.9 Nb-25.4 Ti-2.1 Cr -6.0 Al-29.6 Si | 32.0 Nb-30.1 Ti-1.7 Cr -5.0 Al-31.1 Si |
| #5 | 1500° C./100 h | 42.8 Nb-35.8 Ti-13.1 Cr -7.3 Al-1.0 Si | 34.4 Nb-27.2 Ti-2.0 Cr -3.4 Al-33.0 Si | 30.5 Nb-30.7 Ti-2.6 Cr -2.8 Al-33.4 Si |
| #6 | 1500° C./100 h | 41.8 Nb-33.5 Ti-11.8 Cr -12.0 Al-0.9 Si | 37.9 Nb-24.1 Ti-2.3 Cr -5.6 Al-30.1 Si | |
| #7 | 1500° C./100 h | 43.1 Nb-32.0 Ti-12.3 Cr -11.8 Al-0.8 Si | 38.5 Nb-23.9 Ti-2.4 Cr -6.4 Al-28.8 Si | |
| #8 | 1500° C./100 h | 38.8 Nb-34.2 Ti-12.3 Cr -13.7 Al-1.0 Si | 36.7 Nb-24.3 Ti-2.3 Cr -6.5 Al-30.2 Si | |

*An additional Cr-rich phase ($Cr_2Nb$-base) with composition 21 Nb-16 Ti-51 Cr-4.7 Al-7.3 Si was observed.

Figure 3:
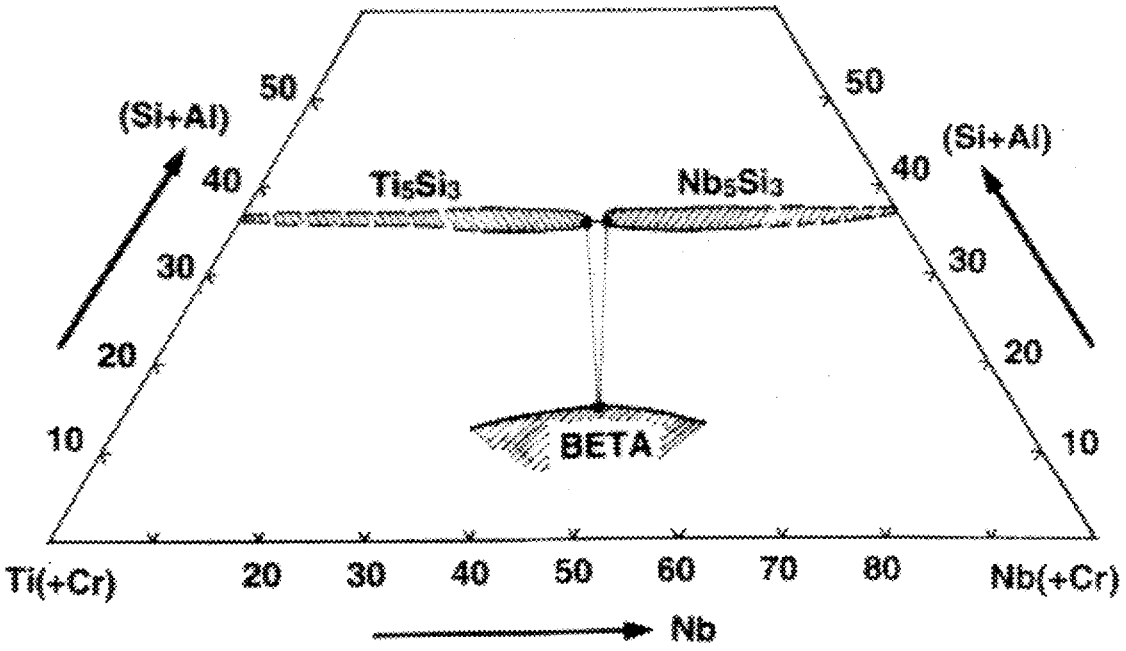
FIG. 3 shows a pseudo-ternary phase diagram at 1500° C. for the niobium-titanium-chromium-aluminum-silicon alloys of the invention.
Figure 4A:
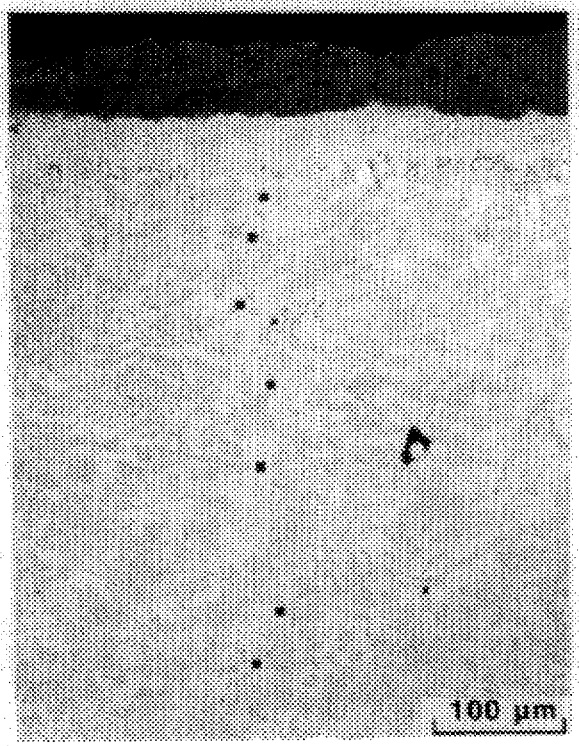
FIG. 4*a* shows an optical micrograph of an alloy (#3) of the invention after oxidation in air at 1200° C. for 24 hours.
Figure 4B:
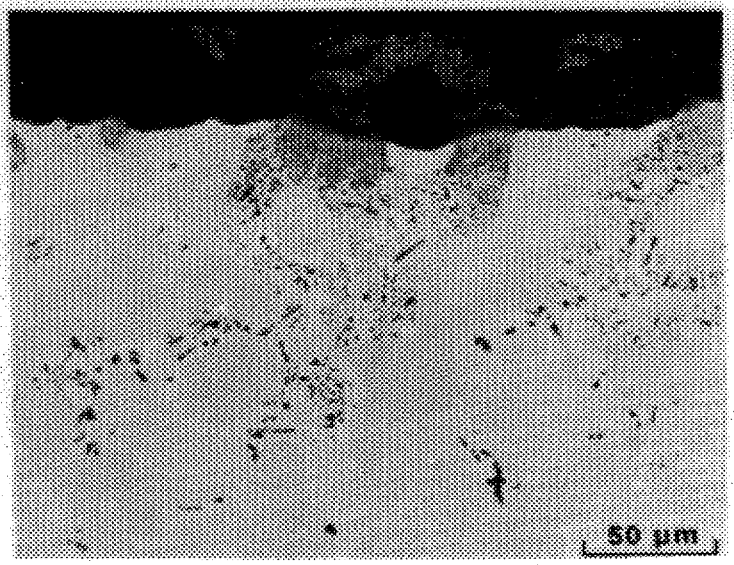
FIGS. 4*b*, 4*c*, 4*d* show backscattered SEM micrographs of three alloys (#4, 5 and 6) of the invention after oxidation in air at 1200° C. for 24 hours.
Figure 4C:
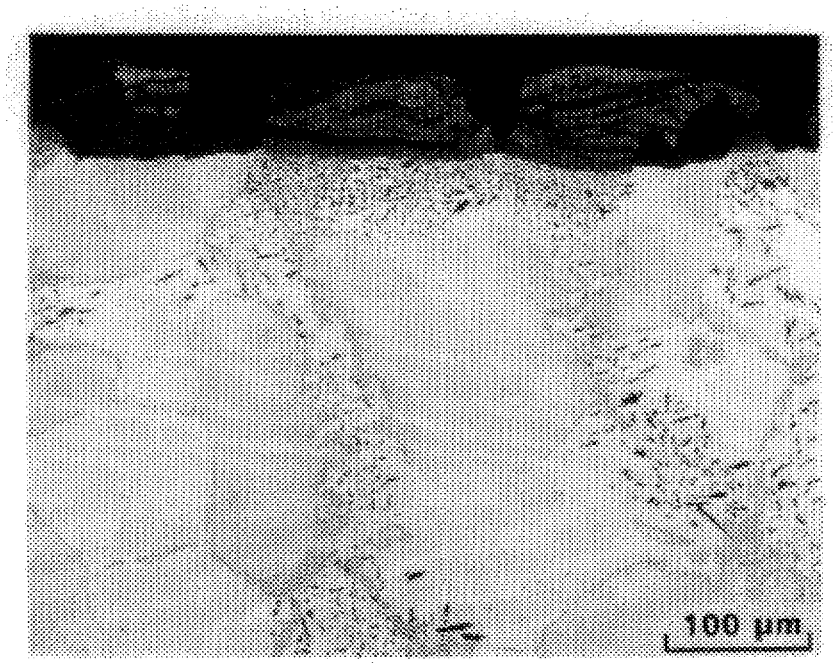
Figure 4D:
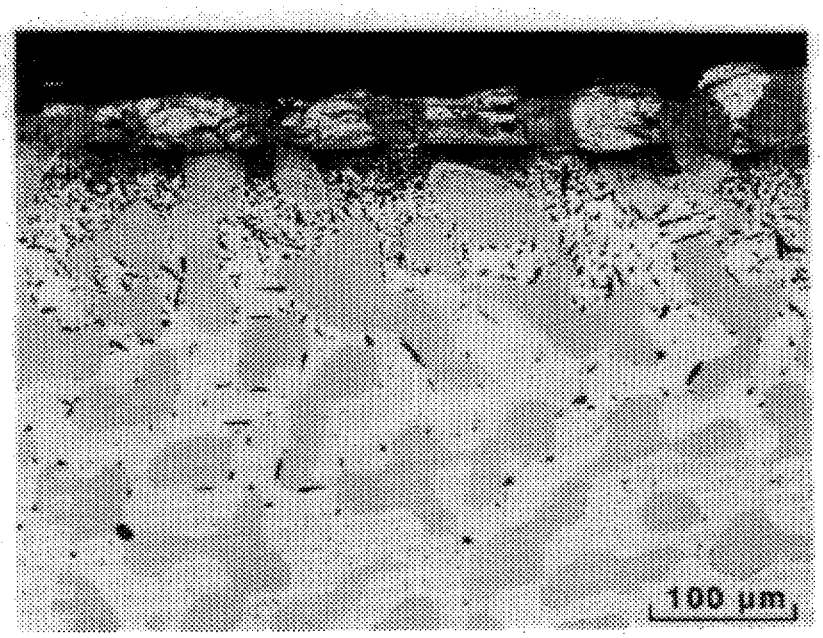

Based on the compositions and x-ray diffraction, phase A is seen as the continuous, matrix areas in FIGS. 2*a* through 2*d*, and is the beta phase with Nb/Ti ratio ranging from about 0.7 to 1.35, Nb ranging from 29 to 44 at %, Ti ranging from 32 to 42 at %, Cr ranging from 10 to 13 at %, Al ranging from about 7 to 18%, and ≦1 at % Si in solution: Phases B and C are the 5:3 $Nb_5Si_3$-base (crystal structure, tetragonal $D8_1$ $Cr_5Si_3$-type) and $Ti_5Si3$-base (crystal structure, hexagonal D88 $Mn_5Si_3$-type) silicites. Phase B is seen as the white, blocky area in FIG. 2*a*, or the gray, discrete phases in FIGS. 2*c* and 2*d*, and has composition in the ranges (34 to 42)Nb-(21 to 28)Ti-(0.5 to 3)Cr-(1 to 7)Al-(28 to 35)Si. Phase C is present in small volume fractions and is seen as black, discrete phases in FIGS. 2*a* and 2*c* and has composition in the ranges (21 to 31)Nb-(30 to 40)Ti-(1 to 3)Cr-(2 to 7)Al-(29 to 34)Si. From the phase analysis, it is evident that the two or three phase field between the Nb-Ti base beta phase and the intermetallic silicides is thermochemically stable up to at least 1500° C. Based on the observed phase equilibria of the representative alloy systems prepared in demonstration of the invention, the pseudo-ternary (Nb+Cr)-(Ti+Cr)-(Al+Si) phase diagram for alloys representative of the invention was prepared and is shown in FIG. 3. The bulk compositions of the alloys (as listed in Table I) as well as the compositions of the equilibrium phases in these alloys (as listed in Table II) are defined in FIG. 3.

Specimens from the annealed alloys were screened for oxidation behavior by exposure at 1200° C. for 24 hours and 1300° C. for 24 hours in an air furnace under static conditions. The oxidized alloys showed a uniform, adherent, and continuous surface oxide layer. Metal recession or loss as a result of oxidation was measured from cross-sectional SEM micrographs of the oxidized sample. FIGS. 4*a–d* show typical micrographs of the oxidized specimens (#3, #4, #5,

#6). The metal recession rates for the alloys were typically determined to be 1.9 to 3.6 microns per hour (μm/h) and 6.6 to 12.0 μm/h at 1200° and 1300° C., respectively. The depth of oxygen penetration in the alloys after oxidation was determined by obtaining a microhardness profile within the beta phase as a function of thickness through the oxidized alloy. The oxygen penetration rates were 7.6 to 9.9 μm/h. The metal recession and oxygen penetration values after oxidation of selected alloys at 1200° C. for 24 hours are listed in Table III.

TABLE III

| Alloy # | Metal Recession (μm/hr) | Oxygen Penetration (μm/hr) |
|---|---|---|
| 2 | 2.7 | — |
| 3 | 1.9 | 9.7 |
| 4 | 3.6 | 7.6 |
| 5 | 3.1 | 9.9 |
| 6 | 1.2 | — |

Figure 5:
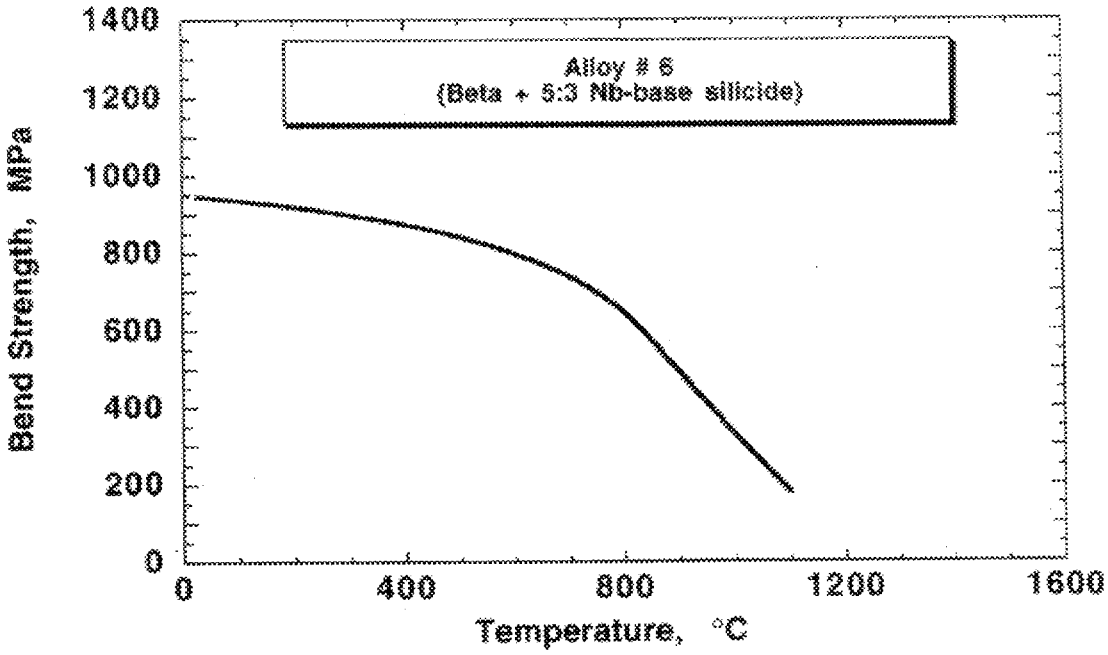
FIG. 5 shows a plot of bend strength versus temperature for an alloy (#6) of the invention.
Figure 6A:
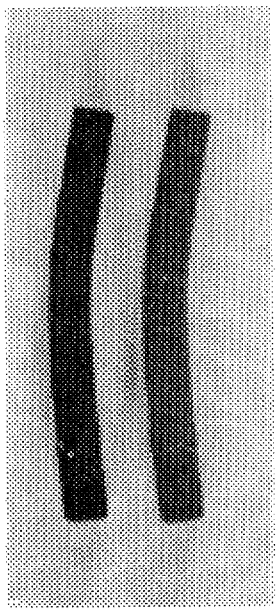
FIG. 6*a* and 6*b* show photographs of four point bend test specimens of the FIG. 5 alloy after bend testing respectively at 1000° C. and 1100° C. in air.
Figure 6B:
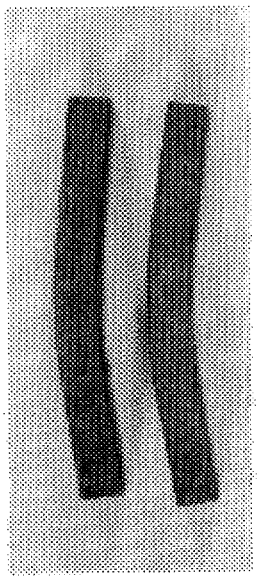
Figure 7A:
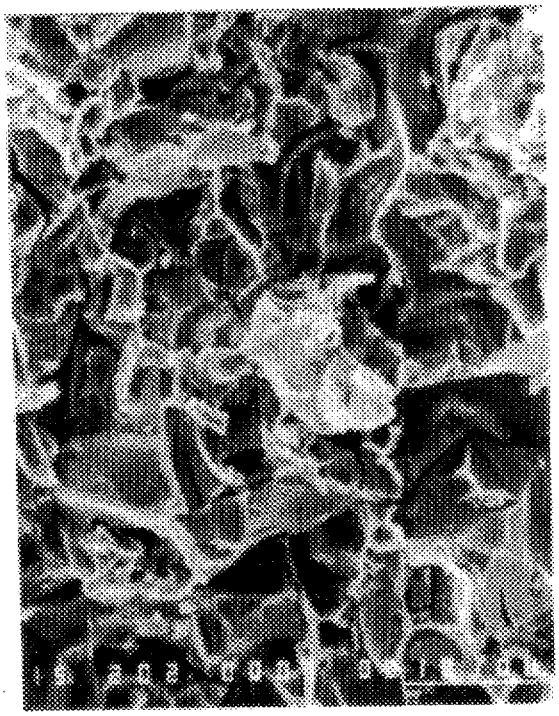
FIGS. 7*a* and 7*b* show SEM fractographs of the alloys of FIGS. 5 and 6 (#6) after bend testing respectively at room temperature and 800° C.
Figure 7B:
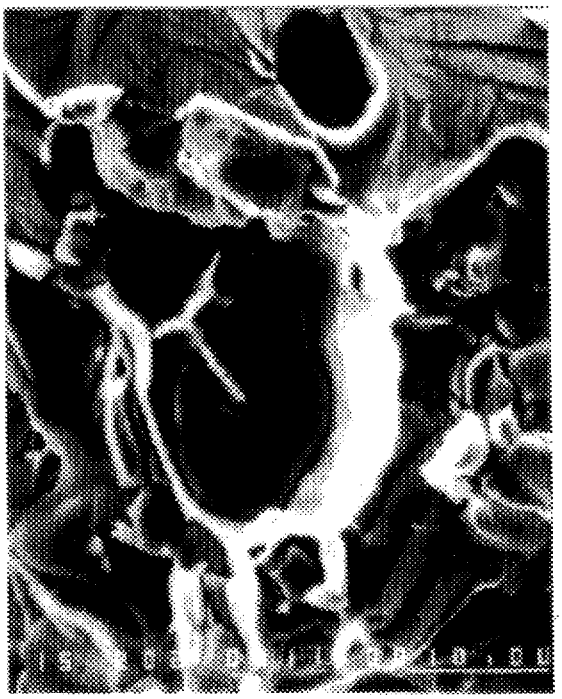

Smooth bend bars (1.125 inch long ×0.25 inch wide ×0.125 inch thick) and single-edge notched bend bars (1.125 inch long ×0.25 inch wide ×0.25 inch thick, notch depth 0.1 inch) were obtained from cast alloy #6 and extruded alloy #7 by electrical discharge machining. The bend bars of alloys #6 and #7 were annealed at 1500° C. for 24 hours and 1500° C. for 24 hours, respectively, prior to testing. Specimens of alloy #7 were subjected to three-point bending tests at room temperature. The results indicated fracture toughness values ranging from 16.0 to 19.6 Mpa√m. The smooth bend bars of both alloy #6 and #7 were subjected to four-point bending tests as a function of temperature. All tests on alloy #6 were conducted in air, in order to evaluate the bend response under air exposure. The tests indicated that this class of alloys possesses good high-temperature strengths at least up to 1100° C. in air. The bend strength data are summarized in Table IV and plotted in FIG. 5. The data at room temperature refer to fracture strengths, while the data above 900° C. refer to elastic strengths. FIG. 6 shows photographs of the bend samples of alloy #6 after testing at 1000 and 1100° C. in air. SEM fractographs of alloy #6 samples tested at room temperature and 800° C. are shown in FIGS. *7a* and *7b*, respectively. FIGS. *7a,b* show that the beta phase failed by plastic stretching and rupture and the intermetallic phase failed substantially by cleavage fracture.

TABLE IV

| Temp | Bend Strength (MPa) | |
|---|---|---|
| (°C.) | Alloy #6 | Alloy #7 |
| 25 | 932 | 839 |
| | 966 | 761 |
| 600 | | 1149 |
| | | 1170 |
| 800 | 635 | 1261 |
| | 676 | |
| 900 | | 715 |
| 1000 | 304 | 310 |
| | 352 | |
| 1100 | 173 | |
| | 179 | |
| 1200 | | 48 |

With reference to a range of microstructures and mechanical properties obtainable in the model system of $Nb+Nb_5Si_3$, the mechanical properties of such alloys will very likely be tailorable by varying the volume fractions of the constituent phases. Typical microstructures that can be obtained by volume fraction variations are (a) continuous beta phase+refractory Nb-base and Ti-base silicide particles, (b) large, primary dendrites of beta phase in a matrix of co-continuous beta+silicide phases, and (c) co-continuous beta+silicide eutectic-type microstructure. The mechanical properties of alloys with these microstructures are tailorable through appropriate thermomechanical treatments, such as hot-extrusion or forging, and/or the use of alternate synthesis techniques such as vapor deposition or powder metallurgy.

The invention is generally applicable to two- or three-phase alloys having compositions (31-41)Nb- (26-34)Ti-(8-10)Cr-(6-12)Al-(9-18)Si. Two-phase beta+$Nb_5Si_3$-base alloys can be Obtained by increasing the Nb/Ti ratio, while three-phase beta+$Nb_5Si_3$-base+$Ti_5Si_3$-base alloys can be obtained by decreasing the Nb/Ti ratio. Alloys with a broader composition range can be obtained by increasing the Cr concentration to form the $Cr_2Nb$-base phase, in addition the two-phase fields of beta+$Nb_5Si_3$-base as well as the three-phase beta+$Nb_5Si_3$-base+$Ti_5Si_3$-base phase fields.

The foregoing alloys may be modified with small amounts (0.2–1.0 wt %) of Zr, Hf or Y or other rare-earth elements for further improvement in oxidation resistance and scale adhesion; or modified with 5–10 at % Ta, Mo, V, W, Re or Ru to raise the melting point, to raise the temperature range of stability of the beta-phase, to improve oxidation resistance, and/or to improve the temperature range of stability of the alloys; or modified with 3–7 at % Ge or In to decrease the viscosity of the silica oxide layer; or modified with interstitial elements such as boron, so as to further improve the oxidation resistance; or modified with small amounts (about 0.1 wt %) of carbon to further improve creep resistance and/or oxidation resistance, or modified by introduction of dispersed phases such as carbide, nitride or silicide precipitates within the beta phase. The Nb-Ti-Cr-Al-Si alloys of the invention may be used as coatings or coating interlayers on other metallic base alloys, such as nickel-base superalloys or refractory-base alloys, or processed by powder metallurgy or vapor-phase synthesis, such as electron-beam evaporation or sputtering, to obtain enhanced microstructural control on a sub-micron scale.

The invention therefore provides improved high temperature melting alloys of niobium-titanium-chromium-aluminum-silicon. It is understood that modifications to the invention may be made as might occur to one with skill in the field of the invention within the scope of the appended claims. For example, similar microstructural forms consisting of a refractory intermetallic phase toughened via a distribution or co-continuous mixture of a ductile refractoy metal phase are likely to exist in numerous refractory metal alloy systems. All embodiments contemplated hereunder which achieve the objects of the invention have therefore not been shown in complete detail. Other embodiments may be developed without departing from the spirit of the invention or from the scope of the appended claims.

We claim:

1. A high temperature melting niobium-titanium-chromium-aluminum-silicon alloy having good low temperature damage resistance and high temperature strength and creep resistance to about 1500° C., comprising:

(a) an alloy composition of niobium, titanium, chromium, aluminum and silicon in the ranges of 31 to 41 atom percent Nb, 26 to 34 atom percent Ti, 8 to 10 atom percent Cr, 6 to 12 atom percent Al, and 9 to 18 atom percent Si;

(b) wherein the alloy composition includes a ductile beta first phase matrix containing from about 29 to 44 atom percent, Nb, 32 to 42 atom percent Ti, 10 to 13 atom percent Cr, 7 to 18 atom percent Al, and less than 1 atom percent Si in solution, wherein the ratio of Nb to Ti is from about 0.7 to 1.35; and, (c) wherein the alloy composition includes at least one of a discrete high temperature melting intermetallic second phase and a discrete high temperature melting intermetallic third phase substantially uniformly distributed within said first phase matrix, said second phase being a $Nb_5Si_3$-base silicide containing about 34 to 42 atom percent Nb, 21 to 28 atom percent Ti, 0.5 to 3 atom percent Cr, 1 to 7 atom percent At, and 28 to 35 atom percent Si, and said third phase being a $Ti_5Si_3$-base silicide containing about 21 to 31 atom percent Nb, 30 to 40 atom percent Ti, 1 to 3 atom percent Cr, 2 to 7 atom percent Al, and 29 to 34 atom percent Si.

2. The alloy of claim 1 wherein said first phase is substantially continuous with particles of said second and third phases substantially uniformly distributed within said first phase, or wherein said alloy composition comprises large primary dendrites of said first phase in a matrix of co-continuous said first, second and third phases, or wherein said alloy composition comprises a co-continuous eutectic-type microstructure of said first, second and third phases.

3. The alloy of claim 1 further comprising about 5 to 10 atom percent of an element selected from the group consisting of Ta, Mo, V, W, Re and Ru.

4. The alloy of claim 1 further comprising about 0.1 weight percent carbon.

5. A high temperature melting niobium-titanium-chromium-aluminum-silicon alloy having good low temperature damage resistance and high temperature strength and creep resistance to about 1500° C., comprising:

(a) an alloy composition of niobium, titanium, chromium, aluminum and silicon in the ranges of 31 to 41 atom percent Nb, 26 to 34 atom percent Ti, 8 to 10 atom percent Cr, 6 to 12 atom percent Al, and 9 to 18 atom percent Si, and about 0.2 to 1.0 weight percent of an element selected from the group consisting of Zr, Hf rare earth metals and Y rare earth element;

(b) wherein the alloy composition includes a ductile beta first phase matrix Containing from about 29 to 44 atom percent Nb, 32 to 42 atom percent Ti, 10 to 13 atom percent Cr, 7 to 18 atom percent Al, and less than 1 atom percent Si in solution, wherein the ratio of Nb to Ti is from about 0.7 to 1.35; and (c) wherein the alloy composition includes at least one of a discrete high temperature melting intermetallic second phase and a discrete high temperature melting intermetallic third phase substantially uniformly distributed within said first phase matrix, said second phase being a $Nb_5Si_3$-base silicide containing about 34 to 42 atom percent Nb, 21 to 28 atom percent Ti, 0.5 to 3 atom percent Cr, 1 to 7 atom percent Al, and 28 to 35 atom percent Si, and said third phase being a $Ti_5Si_3$-base silicide containing about 21 to 31 atom percent Nb, 30 to 40 atom percent Ti, 1 to 3 atom percent Cr, 2 to 7 atom percent Al, and 29 to 34 atom percent Si.

6. The alloy of claim 5 wherein said first phase is substantially continuous with particles of said second and third phases substantially uniformly distributed within said first phase, or wherein said alloy composition comprises large primary dendrites of said first phase in a matrix of co-continuous said first, second and third phases, or wherein said alloy composition comprises a co-continuous eutectic-type microstructure of said first, second and third phases.

7. The alloy of claim 5 further comprising about 5 to 10 atom percent of an element selected from the group consisting of Ta, Mo, V, W, Re and Ru.

8. The alloy of claim 5 further comprising about 3 to 7 atom percent an element selected from the group consisting of Ge and In.

9. The alloy of claim 5 further comprising about 0.1 weight percent carbon.

10. A high temperature melting niobium-titanium-chromium-aluminum-silicon alloy having good low temperature damage resistance and high temperature strength and creep resistance to about 1500° C., comprising:

(a) an alloy composition of niobium, titanium, chromium, aluminum and silicon in the ranges of 31 to 41 atom percent Nb, 26 to 34 atom percent Ti, 8 to 10 atom percent Cr, 6 to 12 atom percent Al, and 9 to 18 atom percent Si, and further comprising about 3 to 7 atom percent Ge or In;

(b) wherein the alloy composition includes a ductile beta first phase matrix containing from about 29 to 44 atom percent Nb, 32 to 42 atom percent Ti, 10 to 13 atom percent Cr, 7 to 18 atom percent Al, and less than 1 atom percent Si in solution, wherein the ratio of Nb to Ti is from about 0.7 to 1.35; and (c) wherein the alloy composition includes at least one of a discrete high temperature melting intermetallic second phase and a discrete high temperature melting intermetallic third phase substantially uniformly distributed within said first phase matrix, said second phase being a $Nb_5Si_3$-base silicide containing about 34 to 42 atom percent Nb, 21 to 28 atom percent Ti, 0.5 to 3 atom percent Cr, 1 to 7 atom percent Al, and 28 to 35 atom percent Si, and said third phase being a $Ti_5Si_3$-base silicide containing about 21 to 31 atom percent Nb, 30 to 40 atom percent Ti, 1 to 3 atom percent Cr, 2 to 7 atom percent Al, and 29 to 34 atom percent Si.

11. The alloy of claim 10 wherein said first phase is substantially continuous with particles of said second and third phases substantially uniformly distributed within said first phase, or wherein said alloy composition comprises large primary dendrites of said first phase in a matrix of co-continuous said first, second and third phases, or wherein said alloy composition comprises a co-continuous eutectic-type microstructure of said first, second and third phases.

12. The alloy of claim 9 further comprising about 5 to 10 atom percent of an element selected from the group consisting of Ta, Mo, V, W, Re and Ru.

13. The alloy of claim 10 further comprising about 0.1 weight percent carbon.

* * * * *